United States Patent [19]

Hayman, Jr. et al.

[11] Patent Number: 4,914,339

[45] Date of Patent: Apr. 3, 1990

[54] MISTING SYSTEM

[76] Inventors: John J. Hayman, Jr., 3151 Holly Mill Run; Itamar C. Kleinberger, 3263 Holly Mill Ct., both of Marietta, Ga. 30062

[21] Appl. No.: 257,731

[22] Filed: Oct. 14, 1988

[51] Int. Cl.[4] ..... F16B 12/00

[52] U.S. Cl. ..... 312/115; 137/177; 137/178; 138/103

[58] Field of Search ..... 137/177, 178; 138/103, 138/140, 125, 126; 312/115

[56] References Cited

U.S. PATENT DOCUMENTS 4,808,303 2/1989 Edwards et al. ..... 312/115

4,808,767 2/1989 Colbachini ..... 138/103 X

*Primary Examiner*—Joseph Falk

*Attorney, Agent, or Firm*—James B. Middleton

[57] ABSTRACT

A misting system is constructed of plastic pipe having a square cross-section, the pipe being dark inside and light outside so that the outside matches the counter and the inside absorbs ultra violet light. The plastic pipe is drilled and threaded to receive nozzle assemblies where needed. Each nozzle assembly includes a valve, and two angled branches, the branches being rotatable about the assembly while the nozzle branches are rotatable about their axes. The square pipe includes fittings for directing the pipe as required, and mounting brackets for mounting the pipe. The brackets are clevises that receive the pipe therein, and include keepers for securing the pipe.

10 Claims, 2 Drawing Sheets

MISTING SYSTEM

INFORMATION DISCLOSURE STATEMENT

It is known that certain foods maintain better condition in very high humidity. For such things as fresh produce, it has long been the custom to spray the produce with a fine mist of water to retain the moisture in the produce and prevent drying of the produce. Though earlier forms of spraying of produce took the form of a spray hose that was utilized manually to spray the produce in a counter, it has now become well known to utilize a permanent spraying system installed in a produce counter, the spraying system including a plurality of nozzles spaced along the counter, and usually including a time clock or the like to provide automatic misting of the produce.

While several automatic misting systems exist, the misting systems generally require installation of a water feed pipe inside the canopy of a produce counter, and the provision of holes through the canopy at every point a misting nozzle is desired. Such an arrangement renders installation quite difficult, and of course requires numerous holes through the produce counter. Also, in the conventional misting system, the system is assembled from conventional pipes and pipe fittings, and requires a rather complex array of pipe fittings and branches to provide the necessary branches for the misting nozzles.

SUMMARY OF THE INVENTION

This invention relates generally to misting systems, and is more particularly concerned with an automatic misting system sufficiently versatile for use in a variety of food display counters.

The present invention provides a misting system including a surface mounted feed line, the feed line being adapted for the providing of tapped holes therealong for receiving nozzle assemblies. Each nozzle assembly is completely adjustable and includes an individual valve with at least one misting nozzle. The misting nozzle includes a check valve for preventing dripping from the nozzle after the water supply has been terminated. The nozzle assembly is threaded into the feed line and includes a nozzle supply line. Each of the nozzles is carried on a branch that is rotatable about the supply line, and each of the branches is preferably angled, and is rotatable about an axis connected to the supply line. With these motions, any combination of motions can be utilized to direct the misting nozzles as desired.

The versatility of the present invention allows use of the misting system in an open produce counter, and including in an island counter. Furthermore, the misting system of the present invention is usable within a closed counter, and it is contemplated that the system of the present invention will be utilized in conjunction with a fresh fish counter.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENTS

Figure 1:
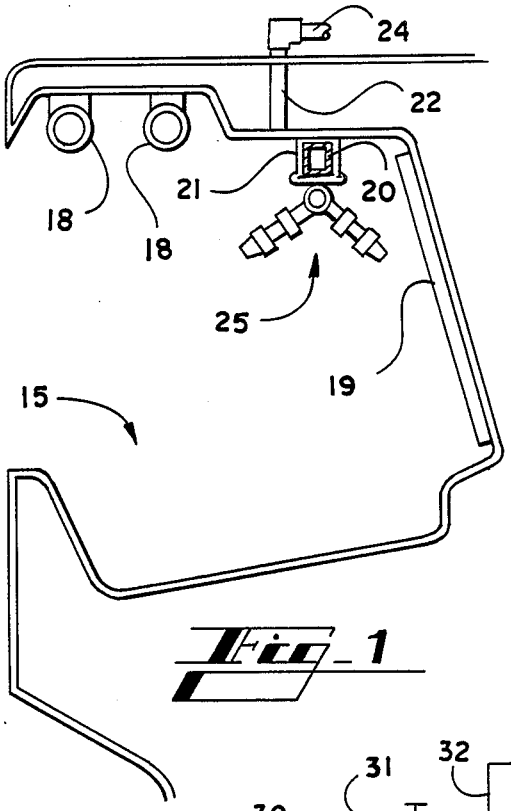
FIG. 1 is a somewhat schematic, transverse cross-sectional view through an open produce counter having the misting system of the present invention installed thereon.

Referring now more particularly to the drawings, and to those embodiments of the invention here presented by way of illustration, FIG. 1 illustrates a somewhat conventional produce counter having a display area 15 covered by a canopy 16. The canopy 16 generally includes one or more lights, such as fluorescent tubes 18. The rear surface 19 is usually a mirror. In conventional misting systems, a feeder pipe is usually extended either through the canopy 16, or above the canopy 16. In the present invention, it will be seen that the feeder line is indicated at 20, and is mounted on the lower surface of the canopy 16. One of the mounting brackets 21 is shown, though it will be understood that a plurality of the brackets 21 support the feeder line 20 as needed. With this arrangement, then, only one line 22 extends through the canopy 16 to the source 24. Below the feed line 20 there is a nozzle assembly generally indicated at 25. Again, a plurality of the nozzle assemblies 25 will be spaced along the length of the produce counter.

Figure 2:
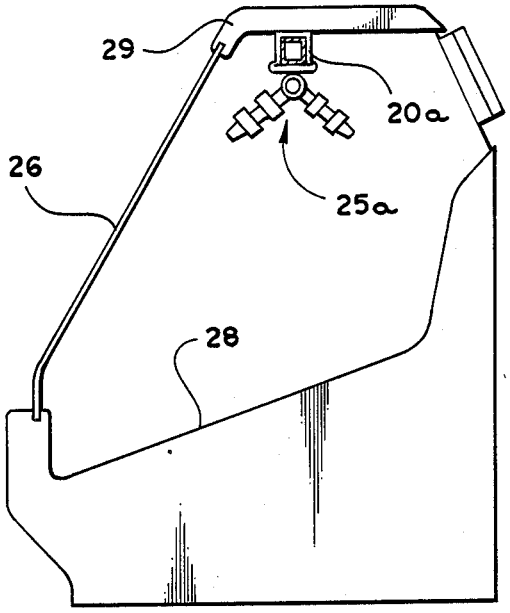
FIG. 2 is a view similar to FIG. 1 showing an enclosed fish counter.

Looking at FIG. 2 of the drawings, a closed fish counter is shown. In FIG. 2, it will be seen that there is a viewing glass 26 through which the customer can view the fish displayed in the display area 28. The top 29 of the counter has the feed line **20*a* extending therealong within the counter, and a plurality of nozzle assemblies 25*a* will be fixed to the feed line 20*a*. In a counter such as that shown in FIG. 2 of the drawings, the feed line 20*a* can be fed from a supply either at the end of the counter, or through the top of the counter as is shown in FIG. 1, or perhaps from the lower portion of the counter, below the display area 28**.

Figure 3:
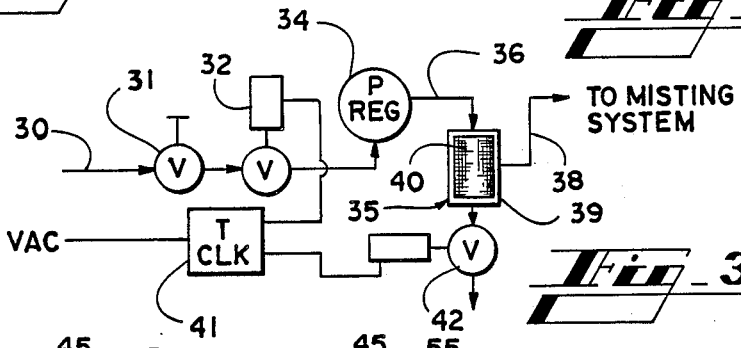
FIG. 3 is a schematic diagram showing the control system utilized with the misting system of the present invention.

Attention is next directed to FIG. 3 of the drawings for an understanding of the control system for the misting system of the present invention. There will be a supply line 30 from the conventional water supply, and a master, manually operated, valve 31 to control the entire system. Following the valve 31, there is a solenoid operated valve 32; and, from the valve 32 the water line extends to a pressure regulator 34, then to a filter generally designated at 35. It will be seen that a line 36 extends from the pressure regulator 34 to one end of the filter 35, and a line 38 extends from the side of the filter 35 to the misting system. The filter 35 is a conventional form of filter wherein the input is into the middle of a cylindrical filter element 39 so that the water must pass from the center of the filter element 39, through the element 39 and into the housing 40, the housing 40 being connected to the line 38.

It will be understood by those skilled in the art that a filter element such as the element 39 will eventually become clogged and will need to be cleaned. The arrangement here illustrated utilizes backwashing for periodic cleaning of the filter.

When the misting system provides water to the various nozzles such as the nozzle 25, it will be understood that the valve 31 is open, and a time clock 41 energizes the solenoid to open the valve 32 while a flush valve 42 remains closed. Water flows through the pressure regulator 34, through the line 36 and into the filter element 38. Water flows through the filter element 39, and into the line 38 to provide water to the misting system. When the time clock 41 indicates that the cycle is ended, the valve 32 will be closed. When the valve 32 is closed, the feed line 20 of the misting system will retain pressure. To reduce this pressure, the time clock 41 will open the valve 42. It will therefore be seen that pressure from the misting system will be fed back to the line 38 and into the housing 40, water will pass through the filter element 39, and can flow outwardly through the valve 42 to an appropriate drain. Thus, this both relieves the pressure on the feedline of the misting system and backwashes the filter element 39.

Figure 4:
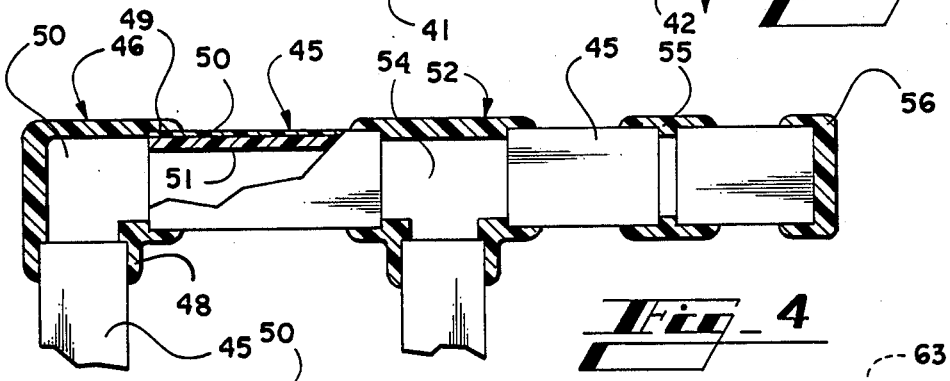
FIG. 4 is a composite view showing the construction of the various fittings for use with the feed line of the present invention.

Attention is next directed to FIG. 4 of the drawings. As is indicated in FIGS. 1 and 2 of the drawings, the feedline 20 or 20*a* of the present invention is formed of a rectangular, or square, pipe. This pipe is unique to the present invention, and various fittings are also provided to allow the pipe to be bent, capped, and branched as required. FIG. 4 is simply a composite showing lengths of square pipe indicated generally at 45 put together by various fittings simply to illustrate the fittings. On the left side of FIG. 4, there is an elbow 46. It will be noted that the elbow 46 includes pipe receiving openings 48 and 49 connected by an open body 50. As is indicated in the drawings, it is contemplated that the piping will all be made of plastic so that conventional glues or the like can be utilized to fix the pipe 45 into the elbow 46.

Extending from the elbow 46 is one section of pipe 45, and a portion of the pipe 45 is in cross-section. Here it will be seen that the pipe 45 is made up of two separate layers 50 and 51. It is intended that the inner, thicker layer 51 be black, while the outer, thinner layer 50 can be white or any other color to match the counter. The purpose of the two layers 50 and 51 is to provide the black layer 51 that will absorb most of the ultraviolet radiation before the ultraviolet radiation contacts the water flowing through the pipe. The outer surface 50 is then simply to provide the desired aesthetic appearance of the pipe to make the pipe blend in well with the counter.

Those skilled in the art will realize that the pipe can be made of any one of numerous plastic materials, but one successful embodiment has been made of chlorinated polyvinyl chloride (CPVC), and the pipe is made by coextrusion so that the outer layer 50 is formed simultaneously with the inner layer 51 to provide indeterminate lengths of the pipe. Next in the line in FIG. 4 of the drawings there is a tee 52. The tee 52 is formed very similarly to the elbow 46, but includes three pipe receiving openings, all connected by an open body 54. Next in line is a coupling 55 followed by a cap 56. The construction of these elements should be readily understood from the description of the elbow, and nothing further should be required.

Figure 5:
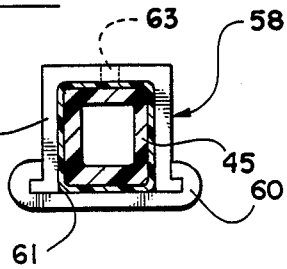
FIG. 5 is an elevational view showing a mounting means for the feed line of the present invention.

Looking at FIG. 5 of the drawings, a mounting bracket for the feedline is illustrated. It will be seen that the mounting bracket is indicated at 58 and includes an omega-shaped member 59 and a keeper 60. The omega-shaped member 59 is provided with a hole 63 so the hanger 58 can be secured to a surface. With the omega-shaped member 59 secured, the pipe 45 can be inserted into the center of the omega-shaped member 59. After the pipe 45 is in place, the keeper 60 can be moved laterally to engage the outwardly turned tips of the member 59.

Figure 6:
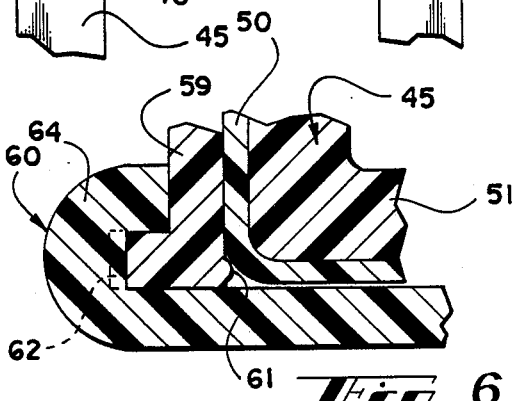
FIG. 6 is an enlarged fragmentary cross-sectional view showing some details of construction of the mounting means shown in FIG. 5 of the drawings.

FIG. 6 is a detailed view showing the construction of the hanger member 58. In FIG. 6 it will be seen that the legs of the member 59 include inwardly extending bosses 61. These bosses are small, but sufficient that a length of pipe 45 can be slipped into the member 59, and the bosses 61 will temporarily secure the pipe 45 within the member 59. With the pipe so secured, the keeper 60 can be moved into position. To hold the keeper 60 in its desired position, the member 59 includes recesses 62 for receipt of tabs 64 on the keeper 60. Thus, the keeper 60 can be moved laterally into position over the member 59, and the tabs 64 will click into place in the groove 62. With the outward pressure exerted by the pipe 45, the keeper 60 will tend to remain in place. Obviously, the keeper 60 can be glued into position if desired.

Figure 7:
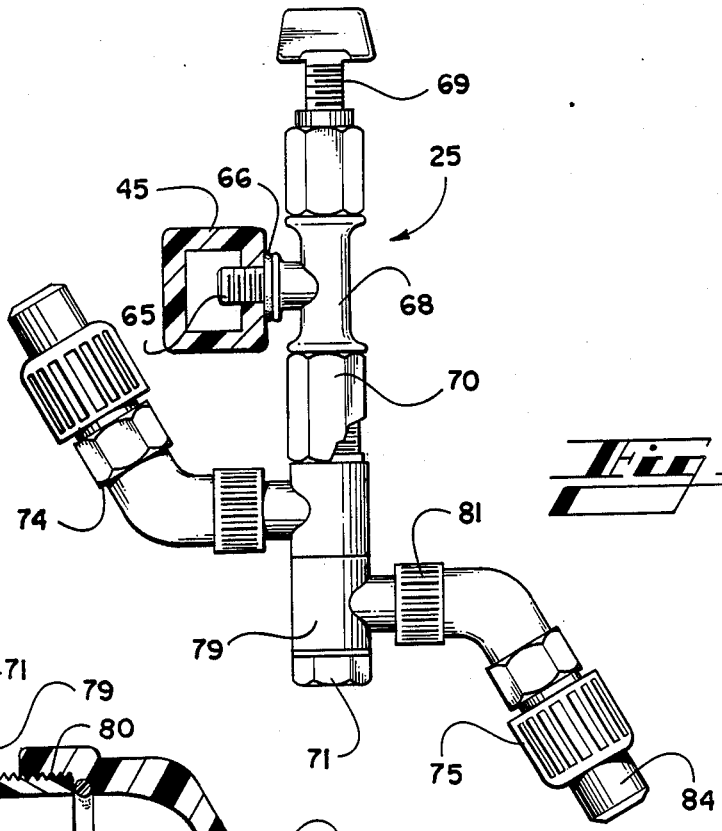
FIG. 7 is an elevational view showing the nozzle assembly made in accordance with the present invention.

In FIG. 7 of the drawings a complete nozzle assembly is shown, and the nozzle assembly is shown fixed to a feedline. The feed line is indicated at 45 since it is a piece of pipe as is shown in FIG. 4, and the nozzle assembly is designated generally at 25 since it is the same as that shown in FIG. 1 of the drawings.

In FIG. 7 it will be seen that the pipe 45 has been provided with a hole, the hole threaded, and a nipple 65 is received within the threaded hole in the pipe 45. There is an O-ring 66 for sealing the nipple 65 in the pipe 45. Thus, water can be provided from the pipe 45 and through the nipple 65 to the valve body 68.

The valve body 68 includes a valve member not here illustrated, but operable by the valve stem 69. Those skilled in the art will understand that, as the valve stem 69 is rotated in one direction, water will be allowed to flow from the nipple 65 and out through the coupling 70. As the valve stem 69 is rotated in the opposite direction, flow will be restricted towards the coupling 70. Thus, each nozzle assembly 25 includes its own valve 68 to allow water to flow or not as desired.

Figure 8:
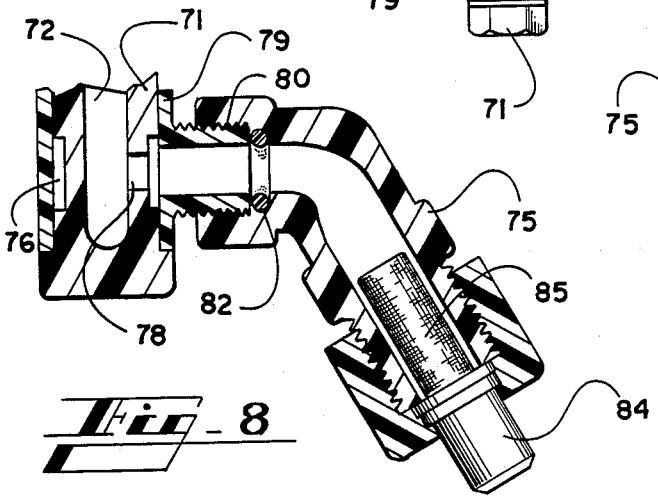
FIG. 8 is an enlarged, diametrical cross-sectional view showing one of the misting nozzles of FIG. 7.

Looking at the misting nozzles in FIG. 7, attention is also directed to FIG. 8 of the drawings. FIG. 8 is a diametrical cross-sectional view through the lower nozzle so that a complete understanding can be had.

It will be seen that the coupling 70 is connected to the valve 68 and to a nozzle axle 71. The nozzle axle 71 has a central bore 72 through which water can flow for supplying the nozzles 74 and 75. It will be seen that the nozzle axle 71 is generally cylindrical, and has portions of reduced diameter 76. There is a hole 78 extending from the central bore 72 and connecting the bore 72 with the outside of the axle 71 in the area of the reduced portion 76. This reduced portion 76 is in conjunction with a nozzle mounting sleeve 79, the sleeve 79 carrying a nipple 80. Thus, it will be seen that water can flow from the central bore 72, through the hole 78 and into an annular channel defined between the sleeve 79 and the reduced portion 76. Water can then flow from this channel into the nipple 80 for feeding the nozzle 75. With this arrangement, it will be readily understood that the axle 71 can be loosened if necessary in its threaded connection to the coupler 70, and the sleeve 79 can be rotated about the axle 71 to place the nipple in any desired rotational position.

The nozzles 74 and 75 include a threaded branch member 81 for threadedly engaging the nipple 80, and including an O-ring 82. Because of the O-ring 82, there is considerably leeway in the tightness of the member 81 with respect to the nipple 80. This allows the member 81 to be placed in almost any rotational position with respect to the nipple 80. Further, it will be noted that the nozzle 75 is angled. Thus, as the branch member 81 is rotated about the nipple 80, the nozzle tip 84 will point in different directions. With the combination of the rotation about the axle 71, and the rotation about the nipple 80, the tip of the nozzle 84 can be pointed in virtually any direction desired.

Figure 9:
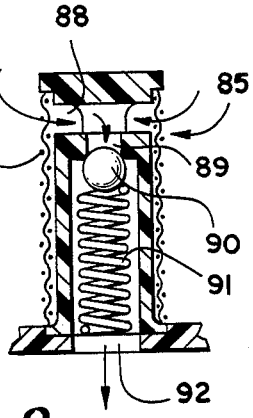
FIG. 9 is a further enlarged, diametrical cross-sectional view showing the check valve and filter shown generally in FIG. 8 of the drawings; and, FIG. 10 is a somewhat schematic view showing the arrangement of the present invention for use in an island counter.

Looking more particularly at FIG. 8 of the drawings, it will be seen that there is a strainer 85 within the nozzle 75. The strainer 85 also includes a check valve which is shown in FIG. 9 of the drawings. Looking at FIG. 9, it will be noted that water can pass through the screen 86 and into the openings 88. From the openings 88, the water must pass through the hole 89; and, if the pressure is sufficient, the water flowing through the hole 89 will push the ball 90 downwardly against the tension of the spring 91 to allow water flow out through the hole 92. At this point, the water will flow from the hole 92 and into the nozzle tip 84 for misting the produce or the like.

Because of the arrangement utilizing the check valve, when the water supply is cut off by the valve 32, there will be a tendency for the ball 90 to seat and close the hole 89 to prevent further discharge from the nozzle. Since the incoming water pressure must be greater than that required to open the check valve, the water pressure confined within the lines may be sufficient to unseat the ball 90 and allow some dripping from the nozzles. For this reason, after the misting cycle, the valve 32 is closed and the valve 42 is temporarily opened to reduce the water pressure on the lines. Once the pressure within the line is reduced, it will be understood that the spring 91 will hold the ball 90 against its seat and prevent dripping from the nozzle.

Figure 10:
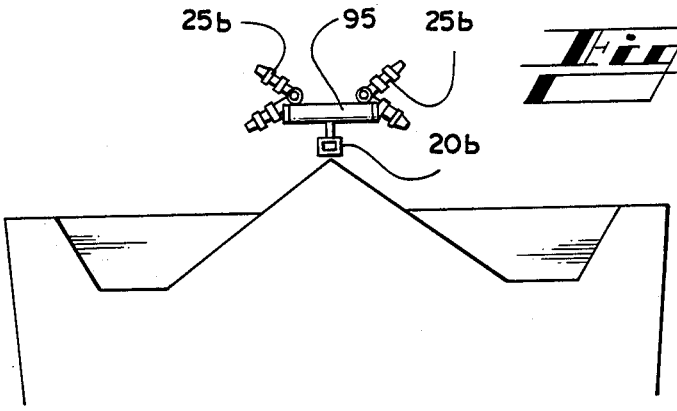

With the above description in mind, it will be readily understood that the system of the present invention provides highly versatile building blocks that can be used as a misting system in virtually any counter. One of the more difficult produce counters to mist is an island counter since the counter does not have the usual canopy 16 or the like. Using the system of the present invention, as is shown in FIG. 10, the feed pipe can be extended down the ridge of the island counter as indicated at **20*b*, and a plurality of short pipe members 95 can be connected to the feeder pipe 20*b*. The ends of the pipe 95 will be capped by cap members 56, and nozzle assemblies 25*b* will be fixed to each end of the pipe 95 as discussed above. it will now be seen that the nozzle assemblies 25*b*** can be adjusted to point as desired and mist the storage area of the island counter.

It will therefore be understood by those skilled in the art that the misting system of the present invention is highly versatile and can be arranged as desired to provide a misting system for virtually any counter. It will of course be understood that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. In a misting system for a display counter for providing an intermittent spray of water, said system comprising a feed line, a water supply, electrically operated valve means connected between said water supply and said feed line, and a timer for controlling said electrically operated valve means to render the spray intermittent, and a plurality of nozzle assemblies spaced along said feed line for providing said spray of water, the improvement wherein said feed line has a rectangular cross-section, at least one hole is defined in a side of said rectangular feed line, said nozzle assemblies include a nipple for attachment to said feed line, said nipple being threadedly received by said hole defined in a side of said rectangular feed line said feed line being formed of two layers, said two layers comprising a first inner layer that is black to absorb ultra violet light and a second outer layer that is colored to be aesthetically pleasing in conjunction with said display counter.

2. A misting system for a display counter for providing an intermittent spray of water, said system comprising a feed line, a water supply, electrically operated valve means connected between said water supply and said feed line, and a timer for controlling said electrically operated valve means to render the spray intermittent, a plurality of nozzle assemblies spaced along said feed line and in communication with said feed line for providing said spray of water, said feed line consisting of an inner layer formed of ultra violet absorptive material, and an outer layer formed of a material to provide an aesthetic combination with the counter, said feed line having a rectangular cross-section, said system further including at least one mounting bracket for mounting said feed line to the counter, said mounting bracket including an omega-shaped member having a pair of inwardly biased legs, and a boss inside said legs for temporarily retaining said feed line within said mounting bracket.

3. A misting system as claimed in claim 2, said legs of said omega-shaped member including a pair of outwardly directed tabs, said bracket further including a keeper receivable over said tabs and extending between said pair of legs for preventing outward movement of said legs with respect to each other.

4. A misting system as claimed in claim 3, said feed line being formed of a polymeric material, said inner layer and said outer layer being coextruded of the same polymeric material, said inner layer including a first additive for rendering said material ultra violet absorptive, said outer layer including a second additive for producing an aesthetic effect.

5. A misting system as claimed in claim 2, wherein the counter comprises a produce counter including a display area, and a canopy over said display area, and wherein said feed line is fixed to the lower surface of said canopy, and said nozzle assemblies depend from said feed line.

6. A misting system as claimed in claim 2, wherein the counter comprises an island produce counter including parallel display areas and a ridge between said display areas, and wherein said feed line extends along said ridge, and further including cross members fixed to said feed line, and wherein said nozzle assemblies are mounted on said cross members.

7. A misting system as claimed in claim 2, wherein the counter comprises an enclosed fish counter including a viewing glass and a top, and wherein said feed line is fixed to said top of said counter within said counter, and said nozzle assemblies depend from said feed line.

8. A misting system as claimed in claim 2, each nozzle assembly of said plurality of nozzle assemblies including a valve having a first nipple threadedly receivable by an opening in said feed line, a valve stem for operating said valve, an axle fixed to and in communication with said valve, said axle having a central bore, at least one reduced diameter portion of said axle, said axle defining a hole extending from said central bore to said reduced diameter portion, a sleeve covering said reduced diameter portion, and a nozzle branch carried by said sleeve.

9. A misting system as claimed in claim 8, said nozzle branch including a nozzle at the end of said nozzle branch, an angle member between said sleeve and said nozzle, and a check valve within said nozzle branch.

10. A misting system as claimed in claim 9, said check valve including a ball normally closing an opening, a spring urging said ball towards said opening against the direction of flow of water when said nozzle receives water for spraying, said system further including a relief valve operable by said timer for relieving pressure on said feed line, said relief valve being opened immediately following closing of said electrically operated valve means, said spring having insufficient force for seating said ball against water pressure when said electrically operated valve is open and sufficient pressure to seat said ball after pressure on said feed line is relieved through said relief valve.

* * * * *